US007114931B2

(12) United States Patent
Wilk et al.

(10) Patent No.: US 7,114,931 B2
(45) **Date of Patent: *Oct. 3, 2006**

(54) ROTARY PUMP

(75) Inventors: Robert A. Wilk, Sierra Village, CA (US); Robert B. Carlsen, Mi-Wuk Village, CA (US)

(73) Assignee: Tilia International, Inc., San Francisco, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 10/917,120

(22) Filed: Aug. 12, 2004

(65) Prior Publication Data

US 2005/0013720 A1 Jan. 20, 2005

Related U.S. Application Data

(63) Continuation of application No. 10/611,180, filed on Jul. 1, 2003, now Pat. No. 6,821,099.

(60) Provisional application No. 60/393,522, filed on Jul. 2, 2002.

(51) Int. Cl.
*F03C 2/00* (2006.01)

(52) U.S. Cl. ..... 418/259; 418/1; 418/15; 418/78; 418/152

(58) Field of Classification Search ..... 418/259, 418/15, 78, 152, 1
See application file for complete search history.

(56) References Cited

U.S. PATENT DOCUMENTS

| | | | | | |
|---|---|---|---|---|---|
| 2,451,666 | A * | 10/1948 | De Lancey | 418/26 |
| 2,463,155 | A * | 3/1949 | Dawes | 418/259 |
| 3,286,913 | A * | 11/1966 | Kaatz et al. | 418/150 |
| 3,686,893 | A * | 8/1972 | Edwards | 418/86 |
| 3,779,216 | A * | 12/1973 | Britt | 418/259 |
| 4,514,157 | A * | 4/1985 | Nakamura et al. | 418/259 |
| 6,565,337 | B1 * | 5/2003 | Henderson | 418/1 |

FOREIGN PATENT DOCUMENTS

| | | | |
|---|---|---|---|
| JP | 03061690 | A * | 3/1991 |
| JP | 11037071 | A * | 2/1999 |

* cited by examiner

*Primary Examiner*—Theresa Trieu
(74) *Attorney, Agent, or Firm*—Perkins Coie LLP

(57) ABSTRACT

A rotary pump includes a stator housing and a rotor. The stator housing preferably has an oblong inner surface. The rotor, which is disposed in the stator housing, preferably has a substantially circular outer surface within which a plurality of vane slots are defined. A first chamber is defined between a first half of the oblong inner surface and the outer surface of the rotor. Similarly, a second chamber is defined between a second half of the oblong inner surface, diametrically opposite the first half, and the outer surface of the rotor. Resting within each of the plurality of vane slots is a corresponding sliding vane. A first inlet port and a first outlet port each provide access to the first chamber. Similarly, a second inlet port and a second outlet port each provide access to the second chamber. At least one of the vanes separates each of the first inlet port, the first outlet port, the second inlet port and the second outlet port from one another.

2 Claims, 15 Drawing Sheets

ROTARY PUMP

CROSS-REFERENCE TO RELATED APPLICATIONS

The present application is a continuation of U.S. patent application Ser. No. 10/611,180 filed Jul. 1, 2003 now U.S. Pat. No. 6,821,090, and entitled, "ROTARY PUMP" which claims the benefit of the filing date of U.S. Provisional Patent Application No. 60/393,522, filed Jul. 2, 2002, both of which are incorporated by reference herein.

BACKGROUND OF THE INVENTION

1. Field of the Invention

The present invention generally relates to pumps, and more particularly to positive-displacement rotary pumps.

2. Description of the Related Art

Positive displacement pumps displace a known quantity of liquid with each revolution of the pumping elements (e.g., vanes). Positive displacement pumps displace liquid or gas by creating a space between the pumping elements and trapping the liquid or gas within the space. Rotation of the pumping elements then reduces the volume of the space and moves the liquid out of the pump. A rotary vane pump is an example of a positive-displacement pump.

Rotary vane pumps operate through the action of a number of rotating vanes or blades. A conventional rotary vane pump includes a rotor assembly eccentrically positioned within a pumping chamber. The number of vanes are spaced around the rotor to divide the pumping chamber into a series of cavities. As the rotor rotates, these cavities rotate around the pumping chamber continually changing in volume due to movement of the vanes and the eccentric alignment of the rotor and pumping chamber. An inlet communicates with the pumping chamber on the side of the pump where the volume of the cavities expand. Similarly, an outlet communicates with the pumping chamber on the side of the pump where the volume of the cavities contract. As each cavity expands, a partial vacuum is created to draw fluid into the pump through the inlet. As the cavity contracts, the pressure within the cavity increases forcing the fluid out of the pump through the outlet. This expansion and contraction process continues for each cavity to provide a continuous pumping action.

There is a desire to improve upon the currently available rotary pumps. For example, there is a desire to reduce the cost of manufacturing rotary pumps while maintaining (and possible increasing) the vacuum level produced by a pump of specific dimensions. There is also the desire to increase the volume of fluid that can be displaced during a period of time by a pump of specific dimensions (i.e., without increasing the overall dimensions of the pump). Further, there is the desire to simplify the manufacturing and assembly required for producing rotary pumps.

BRIEF SUMMARY OF THE INVENTION

The present invention is directed to a dual chamber or double sided rotary pump that includes a stator housing and a rotor.

In accordance with an embodiment, the stator housing has an oblong inner surface. The rotor, which is disposed in the stator housing, has a substantially circular outer surface within which a plurality of vane slots are defined. A first chamber is defined between a first half of the oblong inner surface and the outer surface of the rotor. Similarly, a second chamber is defined between a second half of the oblong inner surface, diametrically opposite the first half, and the outer surface of the rotor. Resting within each of the plurality of vane slots is a corresponding sliding vane. A first inlet port and a first outlet port provide access to the first chamber. Similarly, a second inlet port and a second outlet port provide access to the second chamber. The vane slots are arranged about the outer surface of the rotor such that there is always at least one of the vanes separating each of the first inlet port, the first outlet port, the second inlet port and the second outlet port from one another.

As the rotor is rotated within the stator housing, centrifugal force pushes or urges the vanes radially outward against the inner surface of the stator housing. As this occurs, each of the first and second inlet ports draws in fluid (i.e., gas and/or liquid), and each of the first and second outlet ports expels fluid. More specifically, fluid drawn into the first inlet port is expelled out of the first outlet. Similarly, fluid drawn into the second inlet port is expelled out of the second outlet port. This occurs as described below.

At any given time there exists multiple cavities formed between adjacent pairs of the vanes. For example, there are eight cavities in the embodiment of the present invention where there are eight vane slots and eight vanes. During each full rotation of the rotor, each formed cavity expands and contracts in volume twice. More specifically, each cavity expands in volume as it passes the first inlet port, shrinks in volume as it passes the first outlet port, expands in volume as it passes the second inlet port, and shrinks in volume as it passes the second outlet port. When a cavity expands in volume it creates a partial vacuum, as it passes one of the inlets ports, and thereby draws fluid into the cavity. When the same fluid filled cavity shrinks in volume, as it passed one of the outlet ports, it expels that fluid. Thus, at any given time (while the rotor is rotating at a sufficient speed) two chambers are drawing fluid in and two other chambers are expelling fluid. The remaining chambers are in the process of transferring fluid that has just be drawn in (by one of the input ports) toward one of the outlet ports, so that the fluid can be expelled.

The rotary pump further includes first and second side plates (also referred to as end caps) located opposite one another at axial ends of the stator housing. The first and second side plates together with the stator housing form a hollow oblong cylinder within which the rotor is disposed. One of the side plates may be integrally formed with the stator housing.

In accordance with an embodiment of the present invention, most or all of the rotary pump is manufactured out of plastic. This can significantly reduce the cost and weight of the rotary pump. In accordance with an embodiment, the stator housing and side plates are manufactured from polyetherimide, the rotor is manufactured from polyphenylene sulfide, and the vanes are manufactured from thermoplastic polyimide. For strength, durability and lubrication: the polyethermide can include a carbon fill of about 25–35 percent and a polytetrafluoro ethylene fill of about 10 to 20 percent; the polyphenylene sulfide can include a carbon fill of about 35–45 percent; and the polyimide can include a carbon fill of about 25–35 percent and a polytetrafluoro ethylene fill of about 10 to 20 percent.

Further embodiments, features and advantages of the present invention may be more readily understood by reference to the following description taken in conjunction with the accompanying drawings and claims.

BRIEF DESCRIPTION OF THE DRAWINGS/FIGURES

FIG. 1B is a front section view of a rotary pump with a hose connecting a first inlet port and a second inlet port, in accordance with an embodiment of the present invention.

FIG. 1C is a front section view of a rotary pump with a hose connecting a first outlet port and a second inlet port, in accordance with an embodiment of the present invention.

FIG. 13C is a perspective view of the side plate of the rotary pump of FIG. 9 with a hose connecting a first outlet port to a second inlet port.

DETAILED DESCRIPTION OF THE INVENTION

Figure 1A:
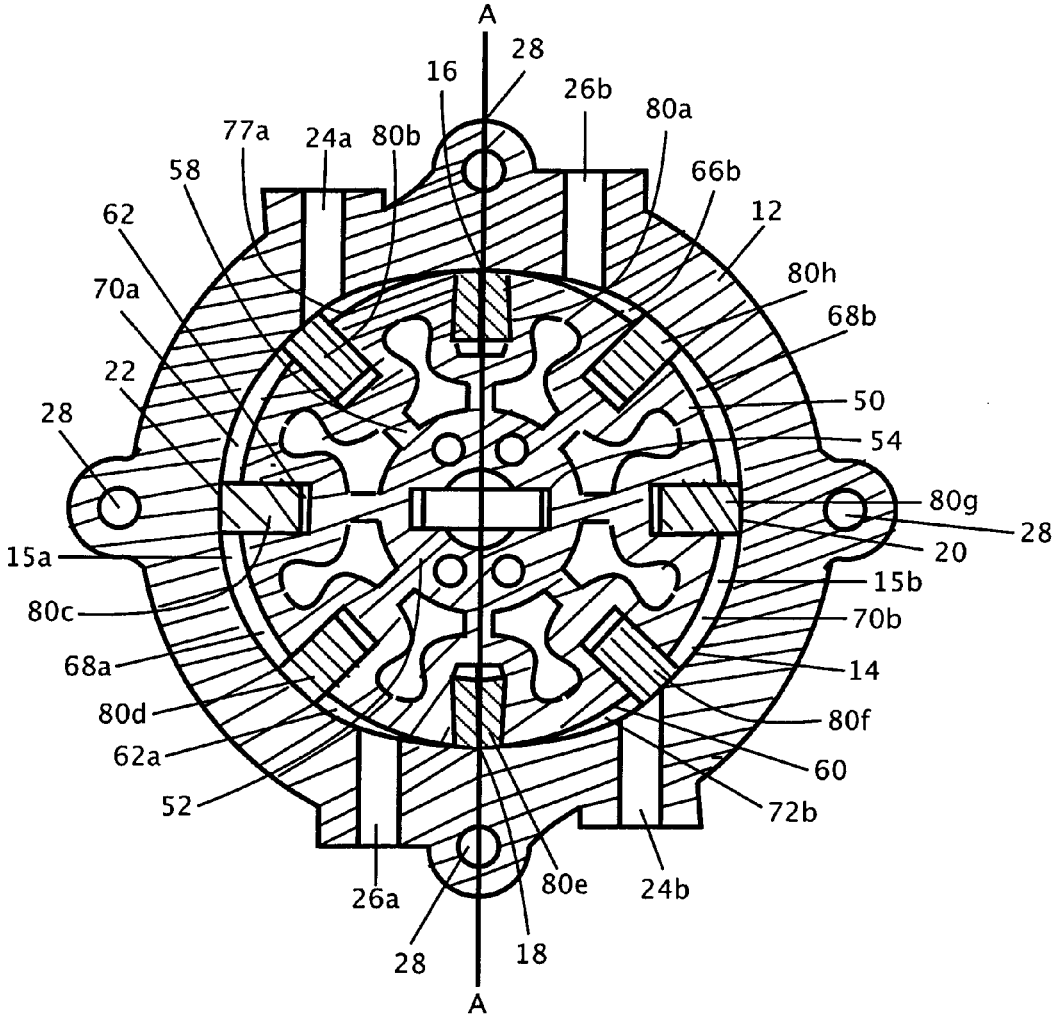
FIG. 1A is a front section view of a rotary pump, according to an embodiment of the present invention.
Figure 3:
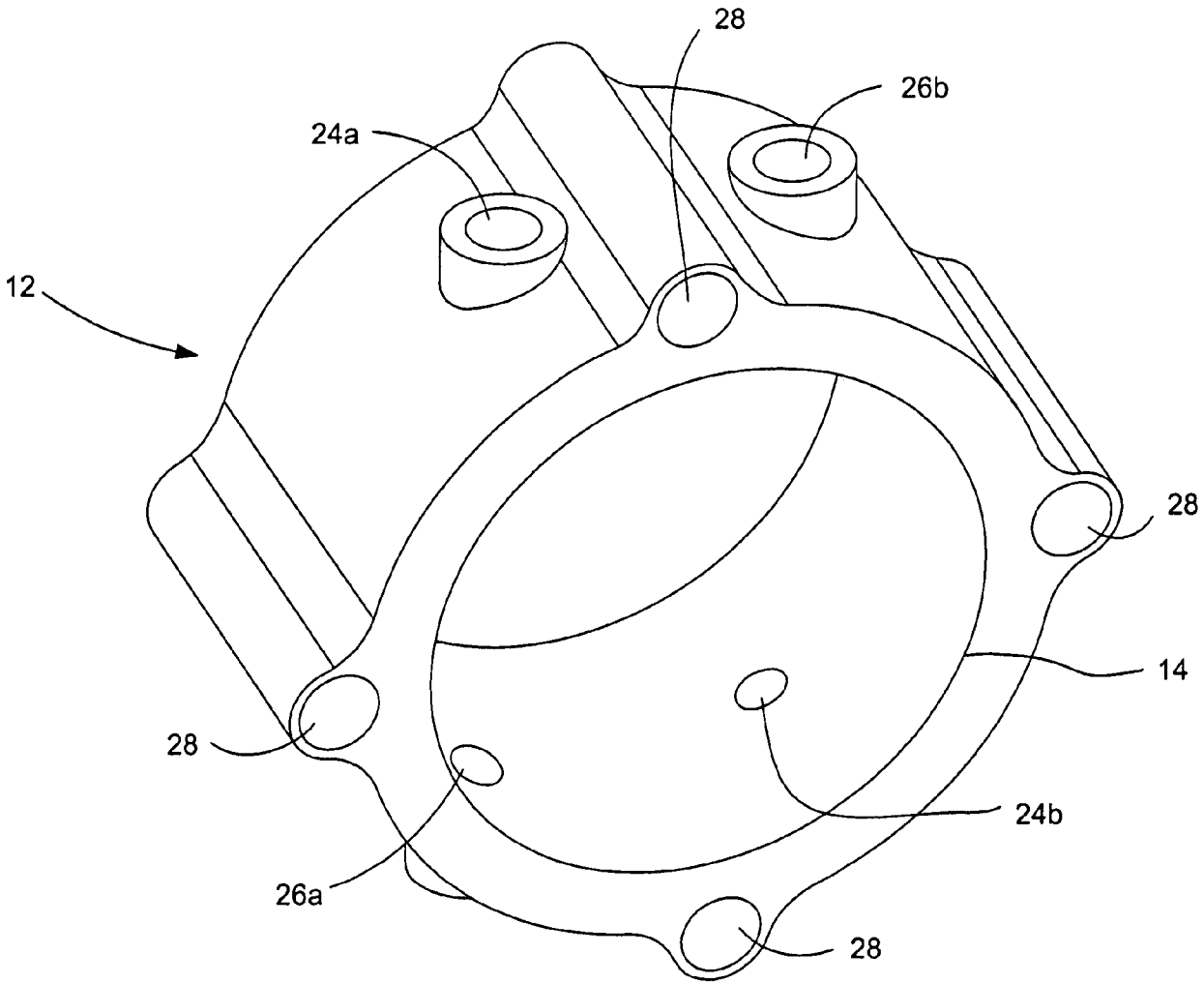
FIG. 3 is a perspective view of a stator housing, according to an embodiment of the present invention.
Figure 4:
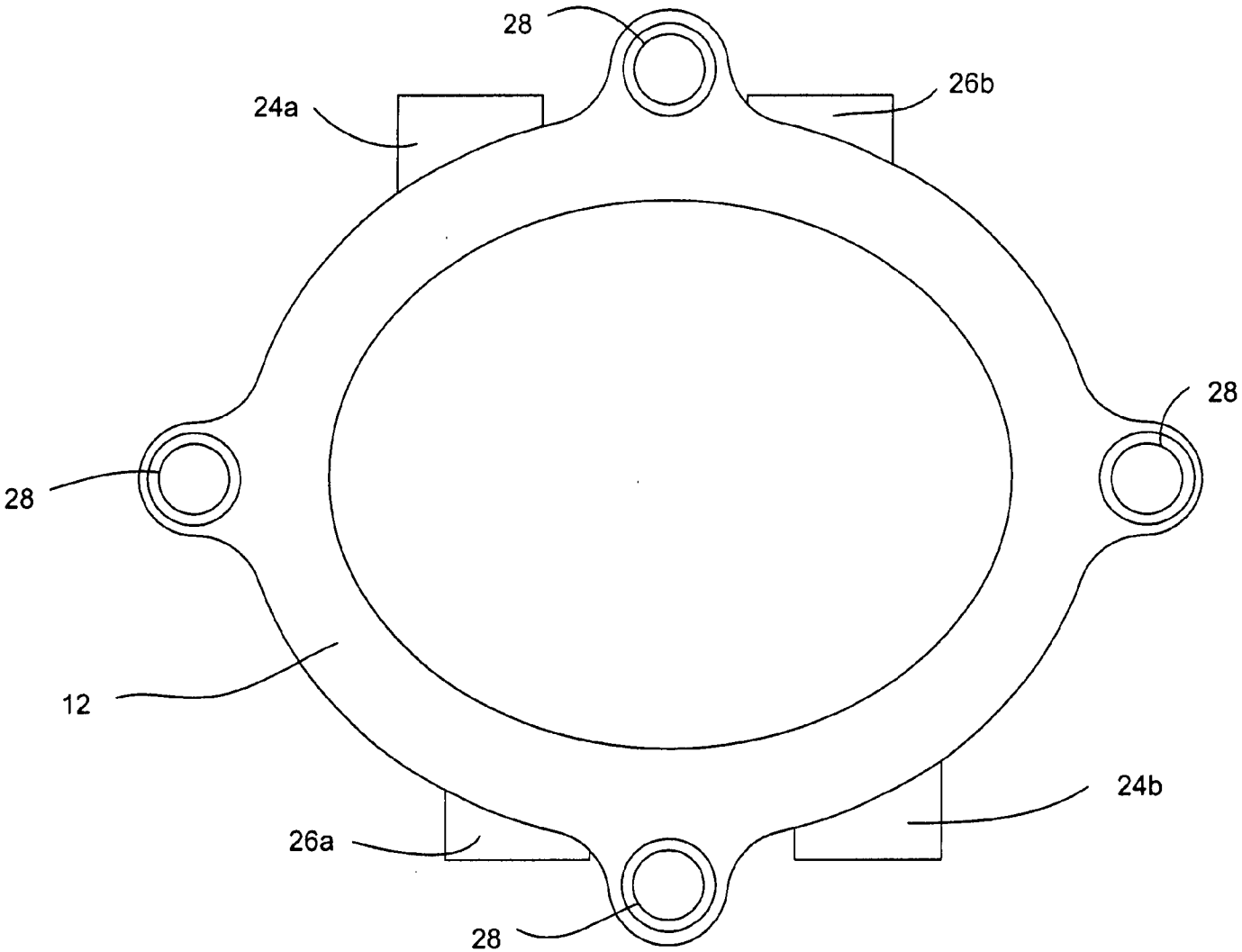
FIG. 4 is a front view of the rotor housing shown in FIG. 3.
Figure 5:
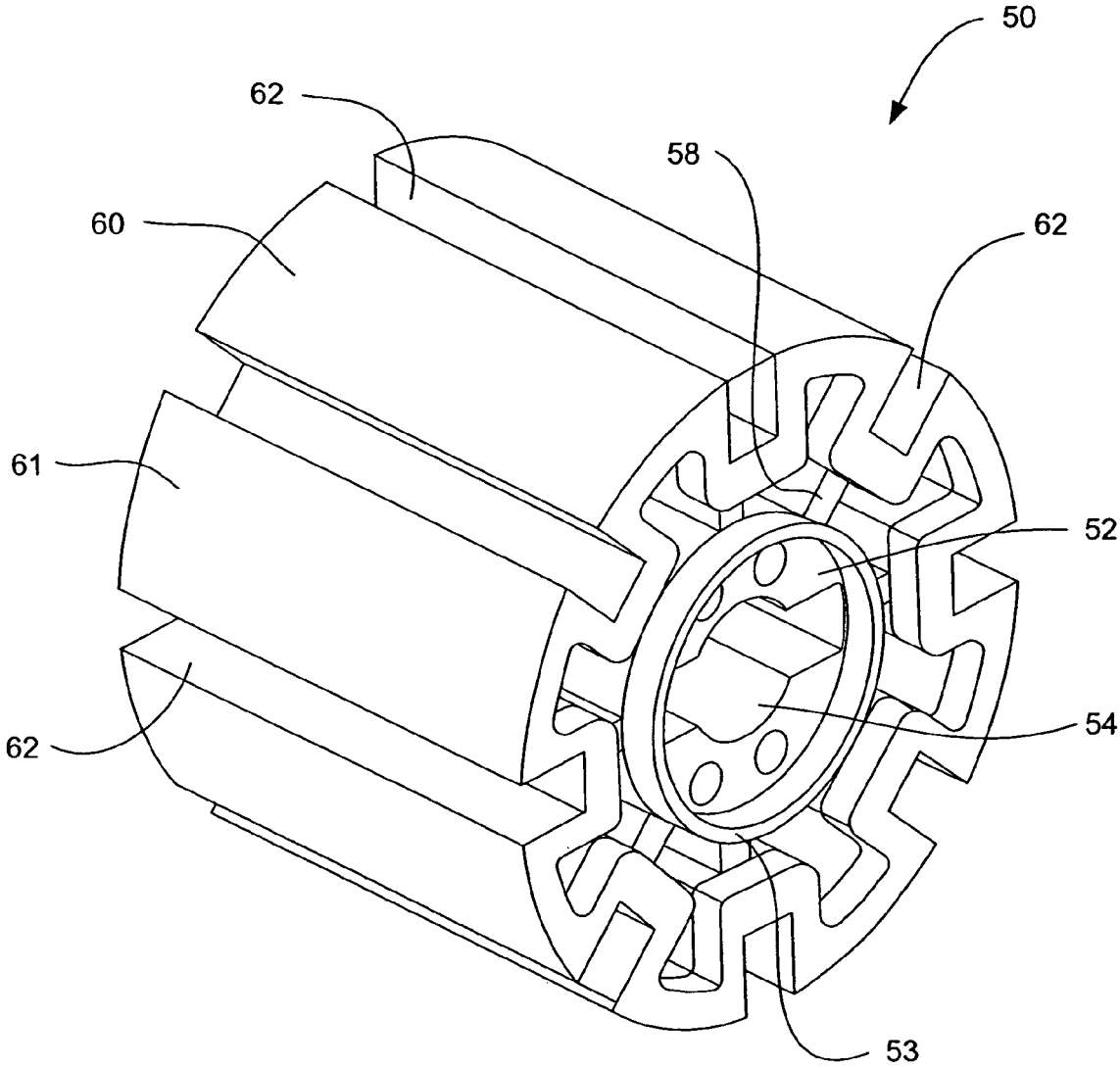
FIG. 5 is a perspective view of a rotor, according to an embodiment of the present invention.
Figure 6A:
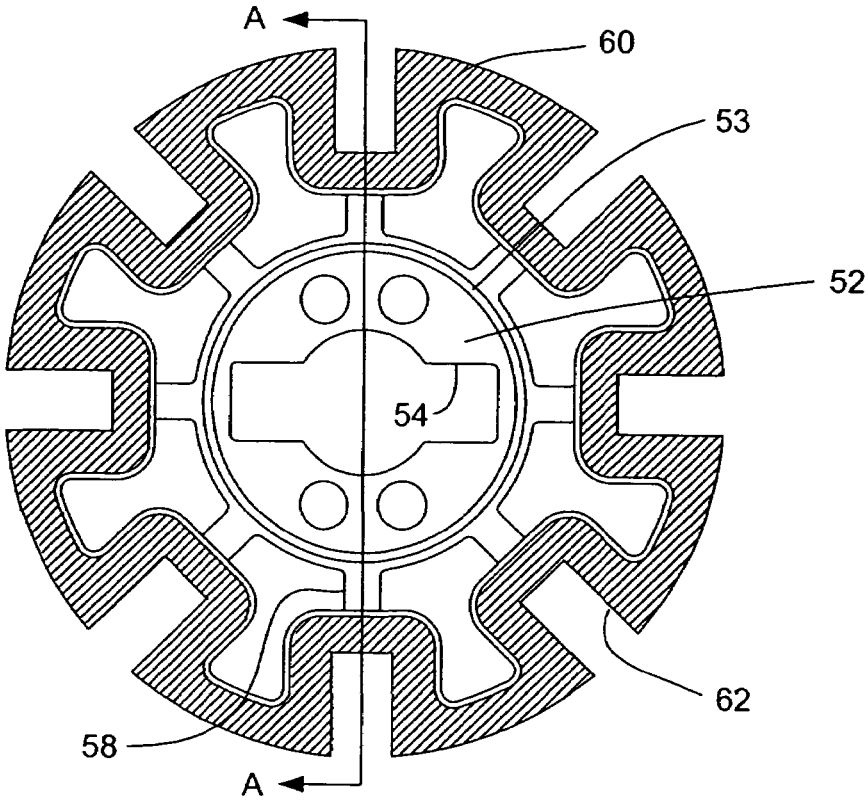
FIG. 6A is a front view of the rotor shown in FIG. 5.
Figure 6B:
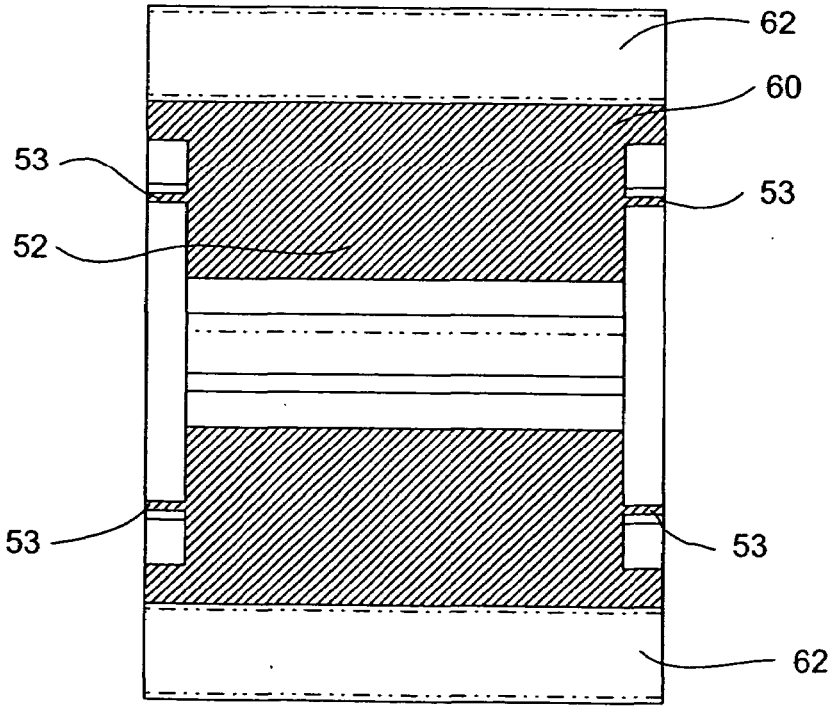
FIG. 6B is a cross sectional view of the rotor shown in FIG. 6A.

FIG. 1A is a front section view of a rotary pump 10 (viewed for the motor side), according to an embodiment of the present invention. Rotary pump 10 includes a stator housing 12 and a rotor 50 disposed in the stator housing. Stator housing 12 has an oblong (e.g., elliptical) inner surface 14, as shown in FIG. 1. Rotor 10 has a substantially circular outer surface 60, within which a plurality of vane slots 62 are defined. Perspective and front views of stator housing 12 are shown, respectively, in FIG. 3 and in FIG. 4. A perspective view of rotor 50 is shown in FIG. 5. Front and cross sectional views of rotor 50 are shown, respectively, in FIG. 6A and FIG. 6B.

Rotor 50 is preferably manufactured as a single unit, and preferably out of plastic, as will be discussed below. Rotor 50 is shown as including a center column 52 and support members 58 extending radially from center column 52. Holes and/or other hollow portions can be included in rotor 50, as shown, to reduce the weight of rotor 50 and the amount of material required to produce rotor 50. Further, if rotor 50 is made of plastic, the lattice like structure (including the holes and other hollow portions) of rotor 50, shown in the figures, allows plastic to flow and fill with minimal deformation during the molding of rotor 50.

A sliding vane 80 rests within each one of vane slots 62. Vane slots 62 extend radially inward from circular outer surface 60 of rotor 50. In accordance with an embodiment of the present invention, each vane 80 rests freely within its corresponding vane slot 62. As rotor 50' rotates, centrifugal force pushes vanes 80 outward against inner surface 14 of stator housing 12, as shown in FIG. 1A. Perspective and side views of a vane 80, according to an embodiment of the present invention, are shown, respectively, in FIG. 7A and FIG. 7B.

As shown in FIG. 1A, a first crescent shaped chamber 15*a* is defined between a first half of oblong inner surface 14 (of stator housing 12) and circular outer surface 60 (of rotor 50). The first half of oblong inner surface 14 is that portion of the inner surface to the left of the line A—A. A second crescent shaped chamber 15*b* is defined between a second half of oblong inner surface 14 (of stator housing 12), diametrically opposite the first half, and circular outer surface 60 (of rotor 50). The second half of oblong inner surface 14 is that portion of the inner surface to the right of the line A—A. In an embodiment where stator housing 12 is symmetrically oblong, about line A—A, a volume of first crescent shaped chamber 15*a* and a volume of second crescent shaped chamber 15*b* are substantially the same. As can be seen in FIG. 1A first crescent shaped chamber 15*a* and second crescent shaped chamber 15*b* are subdivided, by vanes 80, into smaller chambers or cavities that vary in volume as rotor 50 rotates within stator housing 12. For example, in FIG. 1A, first crescent shaped chamber 15*a* includes chambers or cavities 66*a*, 68*a*, 70*a* and 72*a*. Similarly, second crescent shaped chamber 15*b* includes chamber or cavities 66*b*, 68*b*, 70*b* and 72*b*.

A first inlet port 24*a* and a first outlet port 26*a* are each disposed through stator housing 12 and into first crescent shaped chamber 15*a*. A second inlet port 24*b* and a second outlet port 26*b* are each disposed through stator housing 12 and into second crescent shaped chamber 15*b*. Thus, rotary pump 10 is a dual chamber pump. Theoretically, two separate pumps exist, one on each side of line A—A. Stated other ways, rotary pump 10 is a dual input and dual output rotary pump, or a two sided pump. One side or half includes first crescent shaped chamber 15*a*, first inlet port 24*a* and first outlet port 26*a*. The other side or half includes second crescent shaped chamber 15*b*, second inlet port 24*b* and second outlet port 26*b*. As will be explained in more detail below, this enables approximately twice the volume of fluid (gas and/or liquid) to be pumped in a specific amount of time as compared to another pump having similar dimensions.

In accordance with an embodiment of the present invention, there are precisely eight vane slots 80 that are substantially equiangularly spaced apart from each other, as shown in FIG. 1A. More specifically, a center of each of vane slots 62 is spaced approximately 45.degree. apart from adjacent vane slots 62. For the embodiment of the present invention shown in FIGS. 1A–4 first inlet port 24*a* and second inlet port 24*b* are located approximately 180.degree. apart from each other. Similarly, first outlet port 26*a* and second outlet port 26*b* are located approximately 180.degree. apart from each other. In this embodiment, first inlet port 24*a* is at least 90.degree. apart from first outlet port 26*a*, and second inlet port 24*b* is at least 90.degree. apart from second outlet port 26*b*. Further, first inlet port 24*a* is located at least 45.degree. apart from second outlet port 26*b*. Similarly, second inlet port 24*b* is located at least 45.degree. apart from first outlet port 26*a*. The above described angular arrangement, as can be appreciated from FIG. 1A ensures that there is always at least one of vanes 80 separating each of first inlet port 24*a*, first outlet port 26*a*, second inlet port 24*b* and second outlet port 26*b* from one another. Further, there is always at least two vanes 80 separating first inlet port 24*a* from first outlet port 26*a*, and at least two vanes 80 separating second inlet port 24*b* from second outlet port 26*b*. Testing has shown that the use of precisely eight vanes provides optimal performance in maintaining a sure seal between the various ports.

Figure 2:
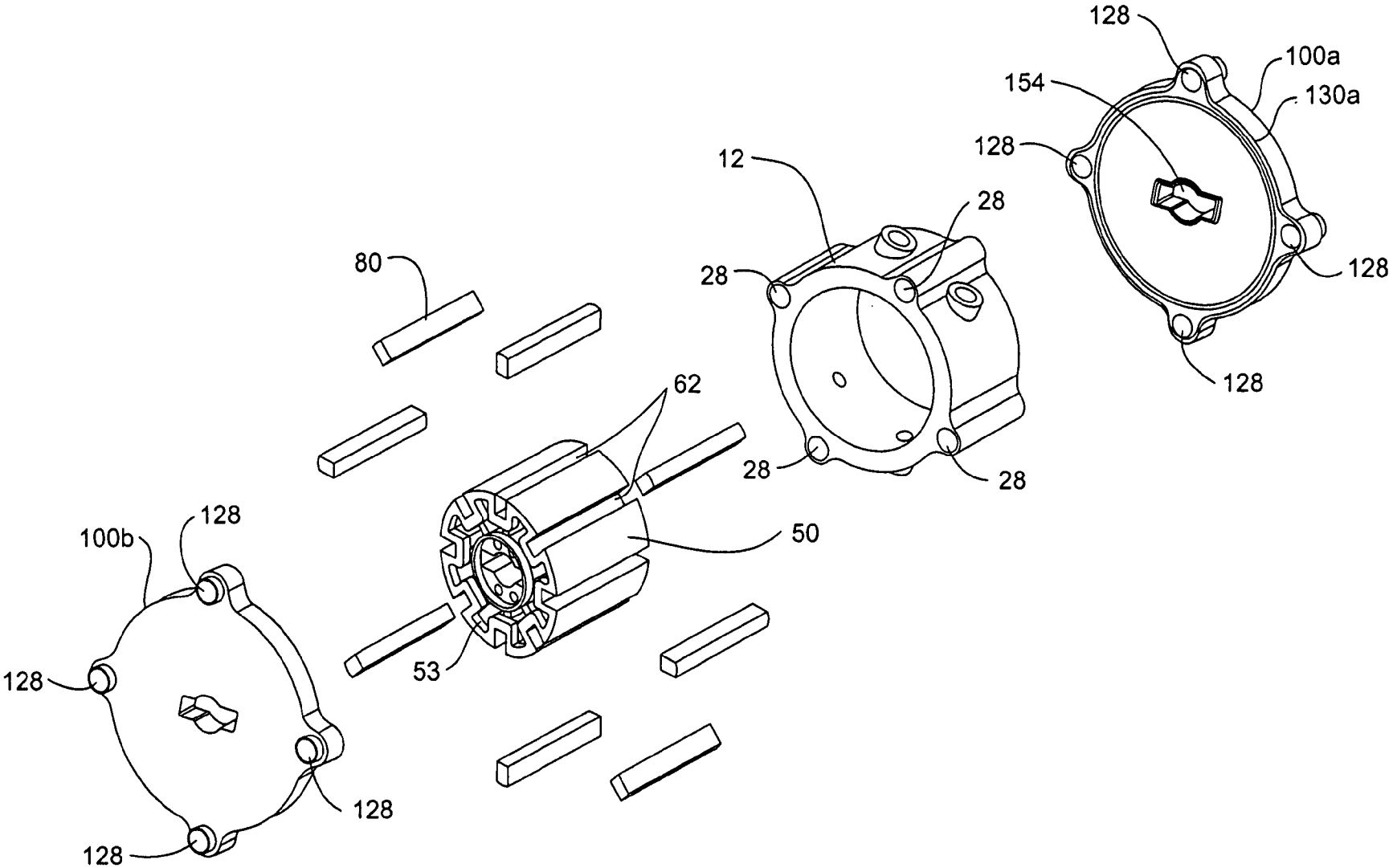
FIG. 2 is an assembly view of the rotary pump shown in FIG. 1.
Figure 8A:
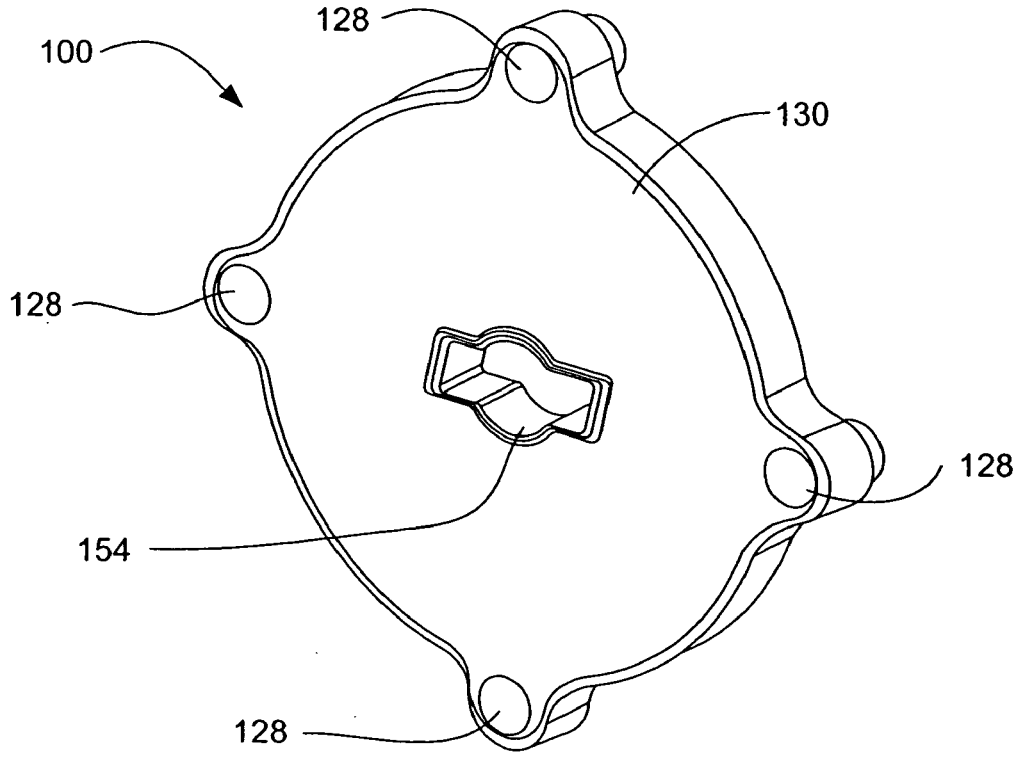
FIG. 8A is a front perspective view of an end cap (also referred to as a side plate), according to an embodiment of the present invention.
Figure 8B:
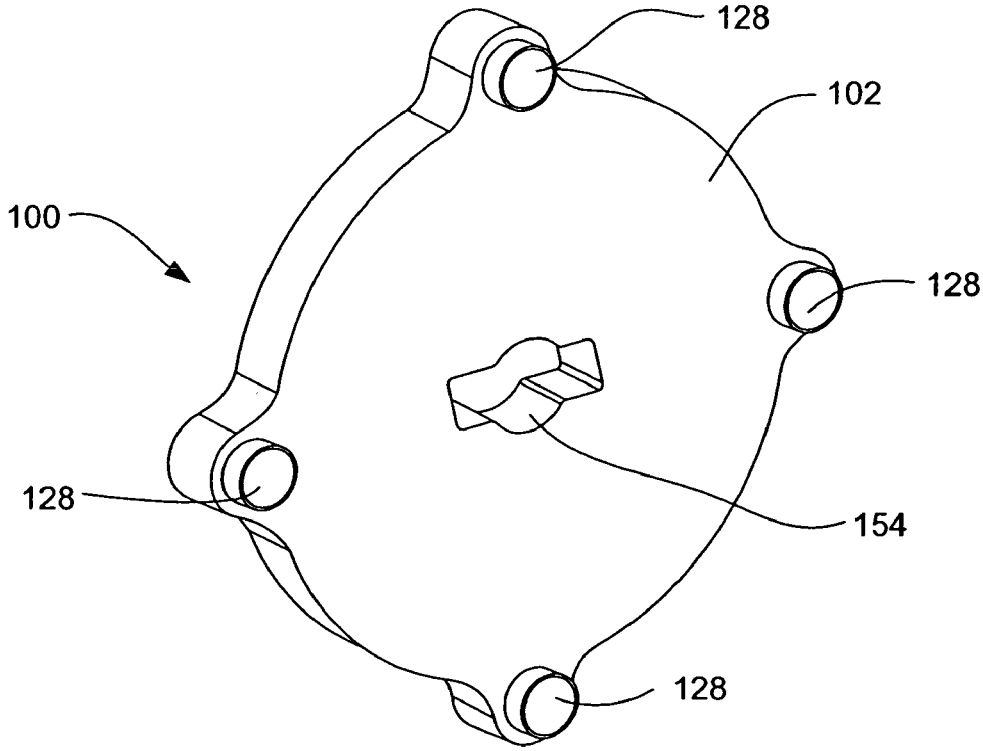
FIG. 8B is a rear perspective view of the end cap of FIG. 8A.

Referring now to FIG. 2, which is an assembly view of rotary pump 10, rotary pump 10 also includes side plates 100*a*, 100*b* (also referred to as end caps) located opposite one another at axial ends of stator housing 12. When rotary pump 10 is assembled, side plates 100*a*, 100*b* together with stator housing 12 form a hollow oblong cylinder within which rotor 50 is disposed. Stator housing includes four bolt holes 28 that extend axially through stator housing, as shown in FIGS. 1–4. Side plates 100*a*, 100*b* include corresponding bolt holes 128, are shown in FIGS. 2, 8A and 8B. To assemble rotary pump 10, four bolts (not shown) are used to clamp or seal side plates 100*a*, 100*b* to ends of stator housing 12, as best shown in FIG. 2. Each bolt extends through a hole 128 in first side plates 100*a*, through a corresponding hold 28 in stator housing 12, and through a further corresponding hold 128 in second side plate 100*b*.

It is noted that one of side plates 100*a* and 100*b* can be integrally formed with stator housing 12. In such an embodiment, only the non-integrally formed side plate 100*a* or 100*b* is connected (e.g., bolted, screwed or welded) to stator housing 12 after rotor 50 is disposed within stator housing 12. In accordance with an embodiment of the present invention, the inner walls of side plates 100*a* and 100*b* (i.e., the walls that face rotor 50 after pump 10 is assembled) are highly polished to minimize the friction between axial ends of rotor 50 and side plates 100*a* and 100*b*.

A centrally located keyhole 154 exists in at least one of (and possible both of) first and second side plates 100*a*, 100*b*. A keyway 54 extends axially into and completely through (or partially through) a center of rotor 50. Keyhole(s) 154 and keyway 54 are for accepting a shaft (including a cross pin) of, or engaged with, an external motor (not shown) that rotates rotor 50 within stator housing 12. Keyway 54 is shaped to substantially conform to an outer surface of the motor's rotating shaft. Keyhole(s) 154 is shaped to allow the drive shaft and cross pin to be inserted through side plate 100 and into keyway 54.

Figure 7A:
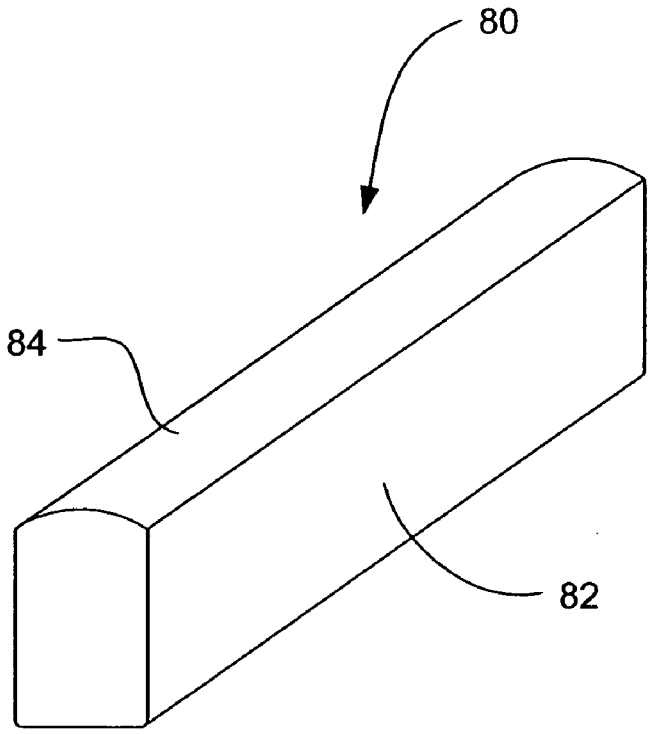
FIG. 7A is a perspective view of a rotor vane, according to an embodiment of the present invention.
Figure 7B:
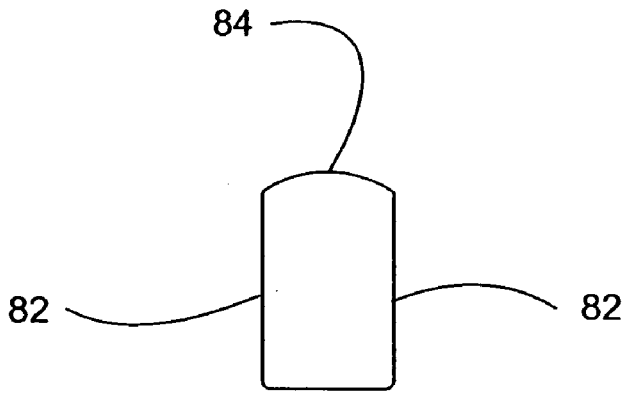
FIG. 7B is a side view of the rotor vane shown in FIG. 7A.

Perspective and front views of vane 80 are shown, respectively, in FIG. 7A and in FIG. 7B. Each vane 80 preferably includes a unitary or one piece body that is suitably sized and configured for being complimentary with a corresponding slot 62 defined in rotor 50. As shown, vane 80 is configured generally as a rectangular bar having flat walls 82 and a curved top 84. In one embodiment of the present invention, each slot 62 is approximately 0.10 inches wide, 0.14 inches tall, and extends through outer surface 60 of rotor 50, which is approximately 0.75 inches long. A width of each vane 80 is slightly less than the width of each slot 62. Similarly, a height of each vane 80 is slightly less than the height (i.e., depth) of each slot 62. This enables each vane 80 to rest completely within its corresponding vane slot 62 as it passes the 12 and 6 o'clock positions shown in FIG. 1.

Each vane 80 is seated within a corresponding slot 62 and is preferably not secured in the slot in any manner. For example, while rotor 50 is not rotating, vane 80*a* located at the 12 o'clock position (in FIG. 1) will slide to a lowermost position such that vane 80*a* is supported by a bottom surface of its corresponding slot 62. In operation, many of vanes 80 may remain seated within their slots 62 until rotor 50 achieves a sufficient speed, for example, 1200 revolutions per minute (RPM). At or past the sufficient speed, centrifugal force causes each vane 80 to extend or slide out of its slot 62 and contact with interior surface 14 of stator housing 12. In accordance with an embodiment of the present invention, rotor 50 rotates at a rotational speed of about 4500 RPM, causing a vacuum of as much as 19.5 inches of mercury.

The operation of rotary pump 10 shall now be explained. As mentioned above, as rotor 50 rotates, centrifugal force pushes or urges vanes 80 radially outward against inner surface 14 of stator housing 12, as shown in FIG. 1. As rotor 50 rotates within stator housing 12, each of first and second inlet ports 24*a*, 24*b* draws in fluid, and each of first and second outlet ports 26*a*, 26*b* expels fluid. More specifically, fluid drawn into first inlet port 24*a* is expelled out of first outlet port 26*a*. Similarly, fluid drawn into second inlet port 24*b* is expelled out of second outlet port 26*b*. This occurs as described below.

Referring to FIG. 1, a first cavity (e.g., cavity 72*a*) is formed or defined by oblong inner surface 14 (of stator housing 12), circular outer surface 60 (of rotor 50), and opposing surfaces of a pair of vanes 80 (vanes 80*a* and 80*b*, in this example). Similarly, a second cavity (e.g., cavity 72*b*) is formed or defined by oblong inner surface 14, circular outer surface 60, and opposing surfaces of another pair of vanes 80 (vanes 80*f* and 80*e*). As rotor 50 rotates (in this example, in a counter clockwise direction), first cavity 72*a* expands in volume as it passes by first inlet port 24*a*, thereby creating a partial vacuum to draw fluid into the cavity through first inlet port 24*a*. As rotor 50 continues to rotate, first cavity 72*a* will shrink in volume as it passes by first outlet port 26*a*, thereby expelling the fluid in the cavity out through first outlet port 26*a*. Similarly, as rotor 50 rotates, second cavity 72*b* expands in volume as it passes by second inlet port 24*b* thereby creating a partial vacuum to draw further fluid into cavity 72*b* through second inlet port 26*b*. As rotor 50 continues to rotate, second cavity 72*b* shrinks in volume as it passes by second outlet port 26*b*, thereby expelling the further fluid in cavity 72*b* out through second outlet port 26*b*.

In the embodiment where there are eight vanes 80, as shown in FIG. 1, at any given time there exists eight cavities formed between adjacent pairs of vanes 80. During each full rotation of rotor 50, each formed cavity expands and contracts in volume twice. More specifically, each cavity expands in volume as it passes first inlet port 24*a*, shrinks in volume as it passes first outlet port 26*a*, expands in volume as it passes second inlet port 24*b*, and shrinks in volume as it passes second outlet port 26*b*. As just explained, when a cavity expands in volume it creates a partial vacuum, as it passes one of inlets ports 24*a* or 24*b*, and thereby draws fluid into the cavity. When the same fluid filled cavity shrinks in volume, as it passed one of outlet ports 26*a* or 26*b*, it expels that fluid. Thus, at any given time (while rotor 50 is rotating at a sufficient speed) two chambers are drawing fluid in and two other chambers are expelling fluid. The remaining four chambers are in the process of transferring fluid that has just be drawn in (by one of input ports 24*a*, 24*b*) toward one of outlet ports 26*a*, 26*b*, so that the fluid can be expelled.

In the above description of the operation of pump 10, rotor 50 rotated in a counterclockwise direction (when viewed from the motor side, as in FIG. 1). It is noted that pump 10 will also operate if rotor 50 is rotated in a clockwise direction. However, when operated in a clockwise direction inlet ports 24*a*, 24*b* will operate as outlet ports, and outlet ports 26*a*, 26*b* will operate as inlet ports. Further, when operated in the clockwise direction performance may drop-off because the port placements as shown are optimized from counter clockwise rotation.

In accordance with an embodiment of the present invention, stator housing 12, rotor 50, vanes 80 and side plates 100 are all made from plastic. The use of plastics to produce these main components of rotary pump 10 can substantially reduce production costs. Plastic components can also reduce the overall weight of rotary pump 10. Usable plastics include, but are not limited to, fluoroelastomer (marketed as Viton™), polyphenylene sulfide (PPS, marketed as Ryton™ and Techtron™), Derlon™, carbon fiber, polytetrafluoroethylene (e.g., marketed as Teflon™), polyetheretherketone (marketed as Peek), polyetherimide (PEI, marketed as Ultem™), polyimide (TPI, marketed as Torlon™), or combinations thereof. Plastic resins may include special additives, such as glass and carbon to enhance performance, reduce wear, improve dimensional stability and/or lower thermal expansion. The plastic may be self lubricating by, for example, being impregnated with polytetrafluoroethylene (e.g., marketed as Teflon™). Components can be manufactured, for example, using compression molding or injection molding.

In accordance with a preferred embodiment of the present invention: stator housing 12 and side plates 100 are manufactured from polyetherimide (PEI, marketed as Ultem™); vanes 80 are manufactured from polyimide (TPI, marketed as Torlon™); and rotor 50 is manufactured from polyphenylene sulfide (PPS, marketed as Ryton™ and Techtron™). Preferably, stator housing 12 and side plates 100*a*, 100*b* include about a 30% carbon fiber fill (±5%) for strength and durability and about a 15% (±5%) polytetrafluoro ethylene (PTFE) fill for lubrication. Preferably, vanes 80 also include about a 30% carbon fiber fill (±5%) for strength and durability and about a 15% (±5%) PTFE fill for lubrication. Preferably, rotor 50 includes about 40% carbon fiber fill (±5%) for strength and durability.

An exemplary plastic that meets the above described properties for stator housing 12 and side plates 100 is available as RTP part number 2185 TFE 15 Nat./Bk. 15. An exemplary plastic that meets the above described properties for vanes 80 is available as RTP part number 4285 TFE 15 Nat./Bk. 15.3. An exemplary plastic that meets the above described properties for rotor 50 is available as RTP part number 1387 TFE 10 L Nat./Bk. 15.

The above mentioned preferred materials as well as the specific percentages of carbon fiber and lubricants for each component of pump 10 were selected after extensive testing of different plastics. The appropriate selection of materials and fills is important because the speeds at which pump 10 operates cause components to become extremely hot, which may cause melting and/or binding of the different components. It was found that materials that run or rub against one another should not be manufactured from the same materials because the same or similar materials tended to undesirably wear through each other and in some instances bind or weld to one another when very hot. It was also found that the components that move, such as vanes 80 and rotor 50, wear differently and more quickly than static components, such as stator housing 12 and side plates 100*a*, 100*b*. There are also different high temperature load points on the components depending on how and where it runs or rubs against other components. The above described materials and fills produced the best results during the extensive testing.

In accordance with an embodiment of the present invention, first inlet port 24*a* and second inlet port 24*b* are connected together, for example, using one or more hoses. For example, FIG. 1B is a front section view of a rotary puma with a hose 420 connecting a first inlet port 24*a* and a second inlet port 24*b*, in accordance with an embodiment of the present invention. This would be useful to create a single point at which fluid is drawn into pump 10. If desired, output ports 26*a* and 26*b* can similarly be connected together to provide a single exhaust point. In another embodiment of the present invention, a hose connects first outlet port 26*a* to second inlet port 24*b* to thereby make rotary pump 10 into a dual stage rotary pump. For example, FIG. 1C is a front section view of a rotary pump with a hose 430 connecting a first outlet port 26*a* and a second inlet port 24*b*. in accordance with an embodiment of the present invention. This can increase the vacuum strength of pump 10, but may reduce the amount of fluid that is displaced during a period of time.

In the embodiments described above, rotor 50 is described as including eight slots 62 within which rest eight sliding vanes 80. In alternative embodiments of the present invention, rotor 50 includes less than eight vane slots 62 (and correspondingly, less than eight vanes 80). Preferably, vane slots 62 are equiangularly spaced apart from each other so that rotor 50 is balanced as it rotates at high speeds. For example, in an embodiment including seven vane slots 62, a center of each of vane slot 62 is spaced approximately 51° apart from adjacent vane slots 62. Enough vane slots 62 (and corresponding vanes 80) are required so that at least one vane 80 is always separating each of first inlet port 24*a*, first outlet port 26*a*, second inlet port 24*b* and second outlet port 26*b* from one another. It is also possible to have more than eight vane slots 62 (and correspondingly more than eight vanes 80). However, as the number of vanes 80 increase, the volume of fluid that can be displaced during a period of time reduces. This is because vanes 80 take up a volume within first and second crescent shaped chambers 15*a*, 15*b*, that otherwise could be transporting fluid.

Although it is preferable that each vane 80 is not attached in any way to rotor 50 (as described above), the present invention would still work if springs (attaching each vane 80 to a corresponding slot 62) are used to push vanes 80 outward against inner surface 14. However, this is not preferable because it causes the manufacture of pump 10 to be more complex and costly.

Figure 9:
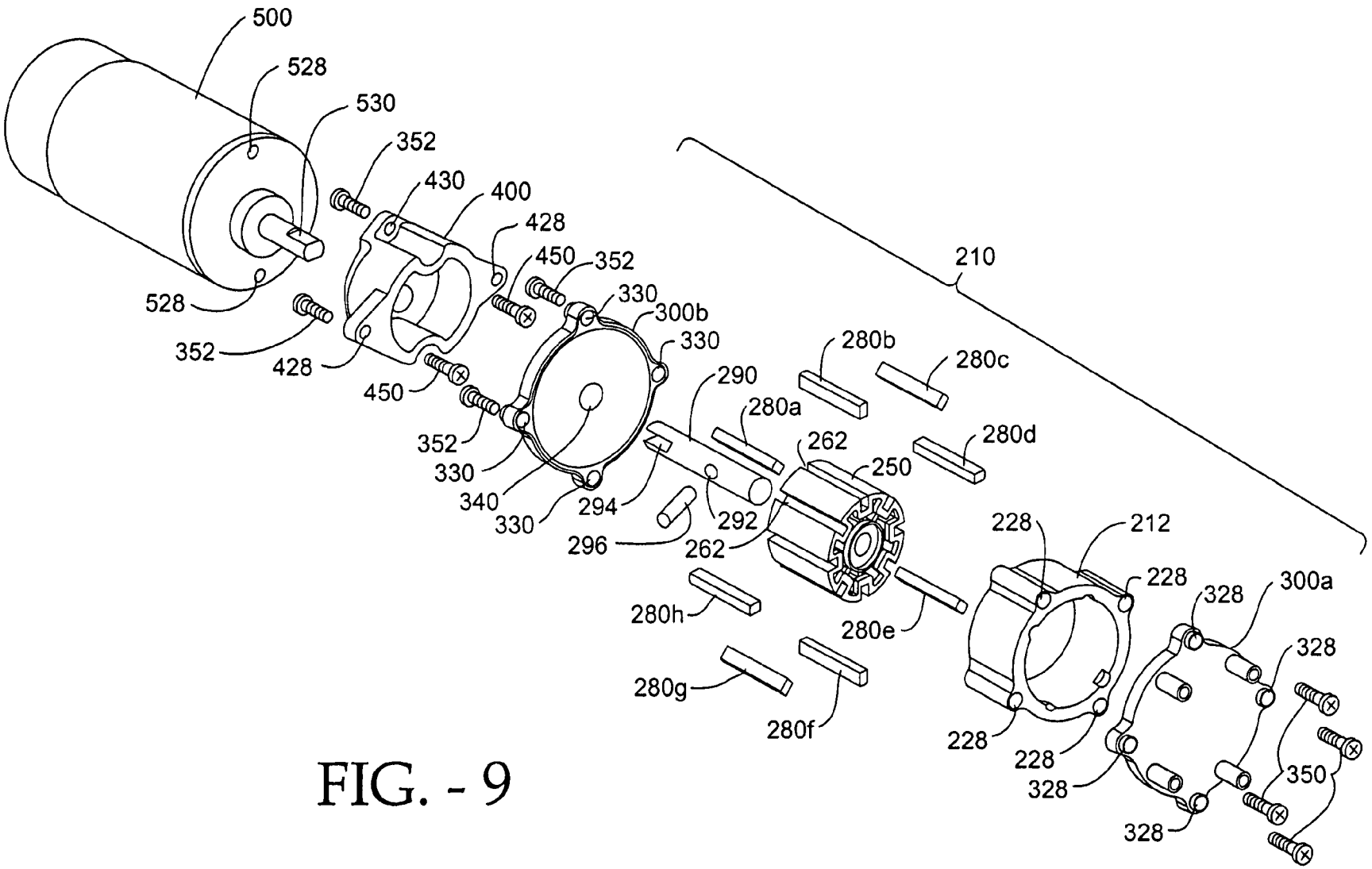
FIG. 9 is an assembly view of a rotary pump, a motor mount, and a motor, according to an alternative embodiment of the present invention.

FIG. 9 is an assembly view of a rotary pump 210, according to an alternative embodiment of the present invention. Rotary pump 210 includes a stator housing 212 and first and second side plates 300*a*, 300*b* (also referred to as end caps) located opposite one another at axial ends of stator housing 212. When rotary pump 210 is assembled, side plates 300*a*, 300*b* together with stator housing 212 form a hollow oblong cylinder within which a rotor 250 is disposed.

An adaptor shaft 290 includes a hole 292 for accepting a cross pin 296. Adaptor shaft also includes a groove 294 to accept a drive shaft 530 of a motor 500. The adaptor shaft 290, with the cross pin in place, fits into and engages with a keyway of rotor 250 (similar to keyway 54 of rotor 50).

Rotor 250 has a substantially circular outer surface, within which a plurality of vane slots 262 are defined. A sliding vane 280 rests within each one of vane slots 262. Rotor 250 is substantially similar to rotor 50 described above. Sliding vanes 280 are substantially similar to sliding vanes 80 described above. Further, stator housing 212 is somewhat similar to stator housing 12 described above. Accordingly, to avoid being repetitive, much of the following description is limited to the differences between the elements of pump 210 and the corresponding elements of pump 10 described above.

Figure 10:
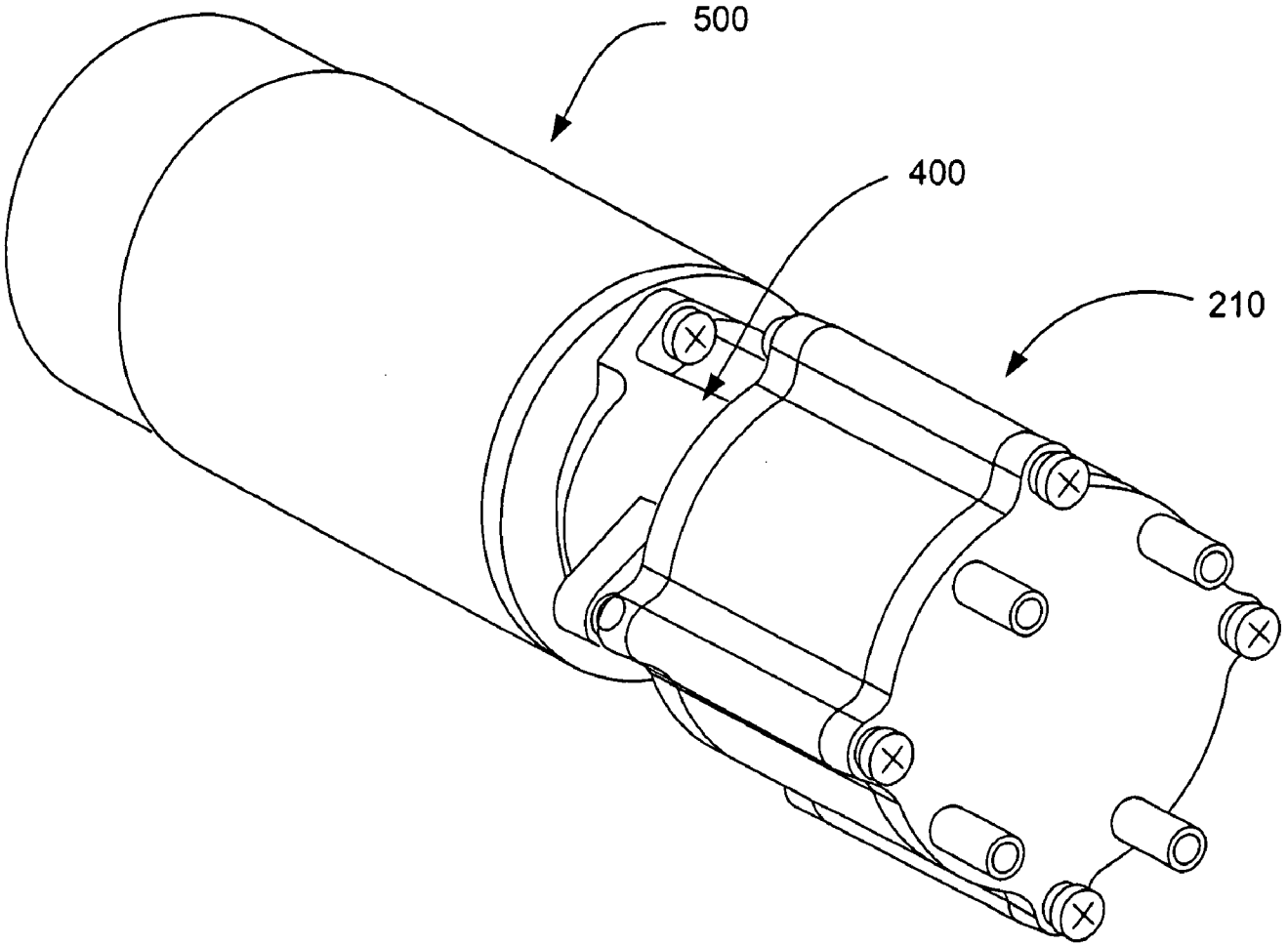
FIG. 10 is a fully assembled perspective view of the rotary pump of FIG. 9 with the motor mounted using the motor mount, according to an embodiment of the present invention.

Stator housing 212 includes four threaded screw holes 228 that extend axially through stator housing 228. Side plate 300*a* includes corresponding screw holes 328, and side plate 300*b* includes corresponding screw holes 330. To assemble rotary pump 210, four screws 350 are used to attach or seal side plate 300*a* to stator housing 212, as best shown in FIG. 10. Adaptor shaft 290, with cross pin 296, are slid into the center keyway of rotor 250, as mentioned above. Referring again to FIG. 9, four screws 352 are used to attach or seal side plate 300*b* to the other end of stator housing 212.

Two of the four screws 352, are inserted through holes 428 of a motor mount 400, to thereby attach motor mount 400 to rotary pump 210, as can be seen best in FIG. 10. Drive shaft 530 is inserted through hole 440 of motor mount 400, and through hole 340 of side plate 300*b*. A blade like portion of drive shaft 530 fits within groove 294 of adaptor shaft 290. Two additional screws 450, are inserted through screw holes 430 of motor mount 400, and screwed into screw holes 528 of motor 500, to thereby attach motor 500 to motor mount 400. In this manner, motor mount 400 mounts motor 500 to rotary pump 212, as best shown in FIG. 10. Of course, the precise order of assembly can be altered.

Figure 13A:
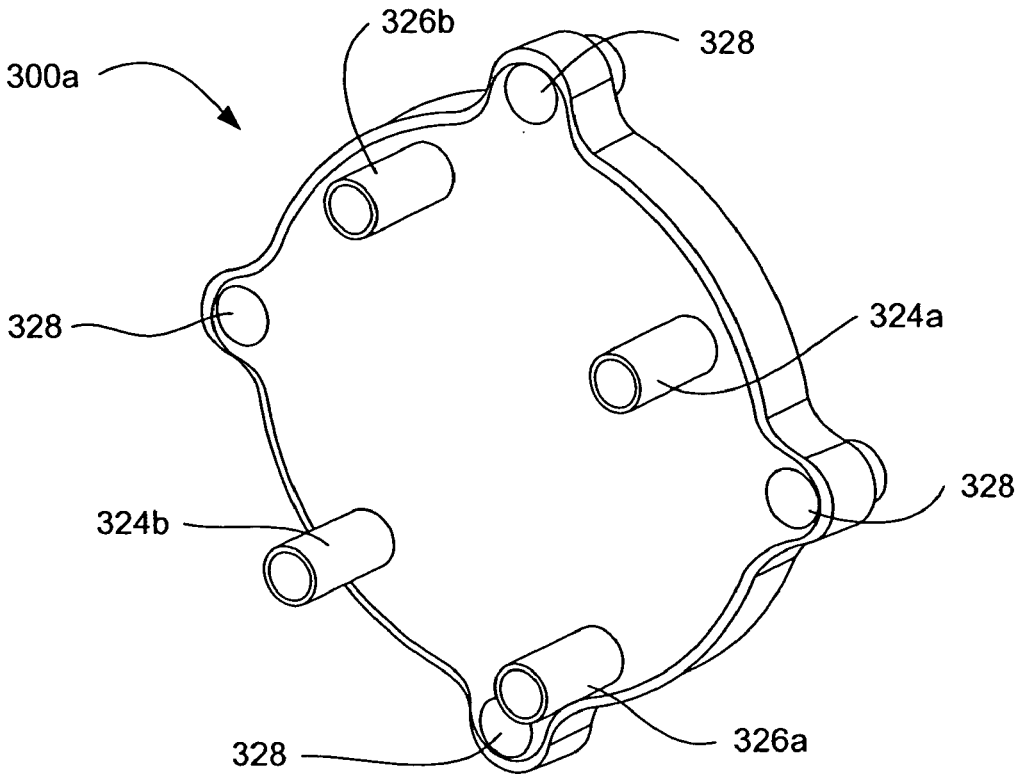
FIGS. 13A, 13B, 14A and 14B are perspective views of the side plates of the rotary pump of FIG. 9, according to embodiments of the present invention.
Figure 13B:
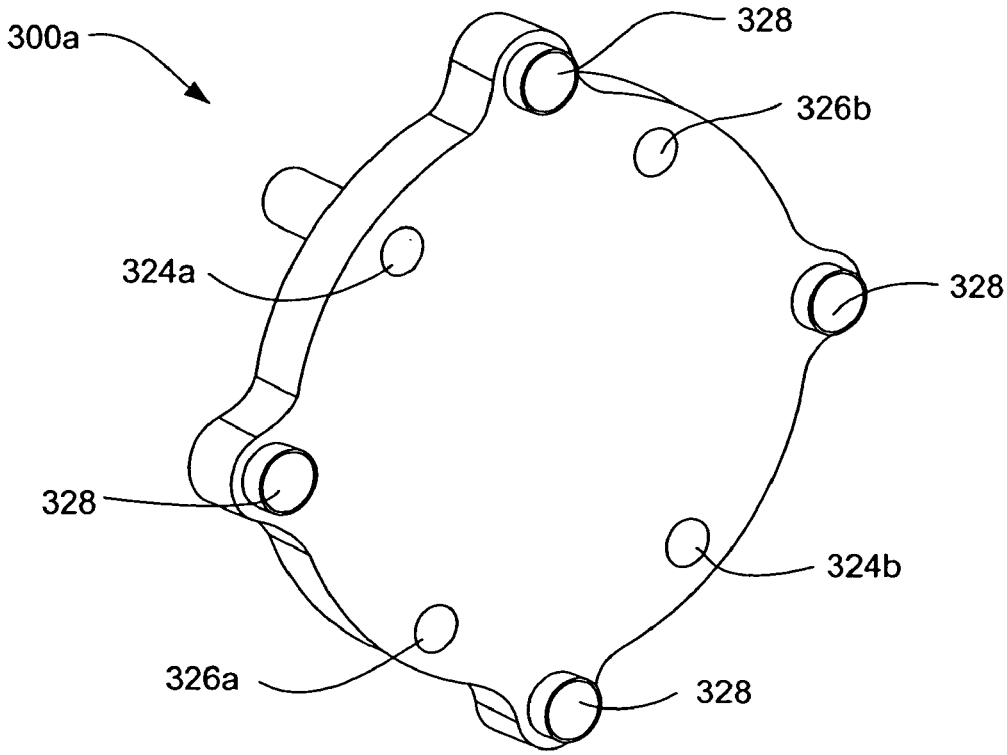
Figure 14A:
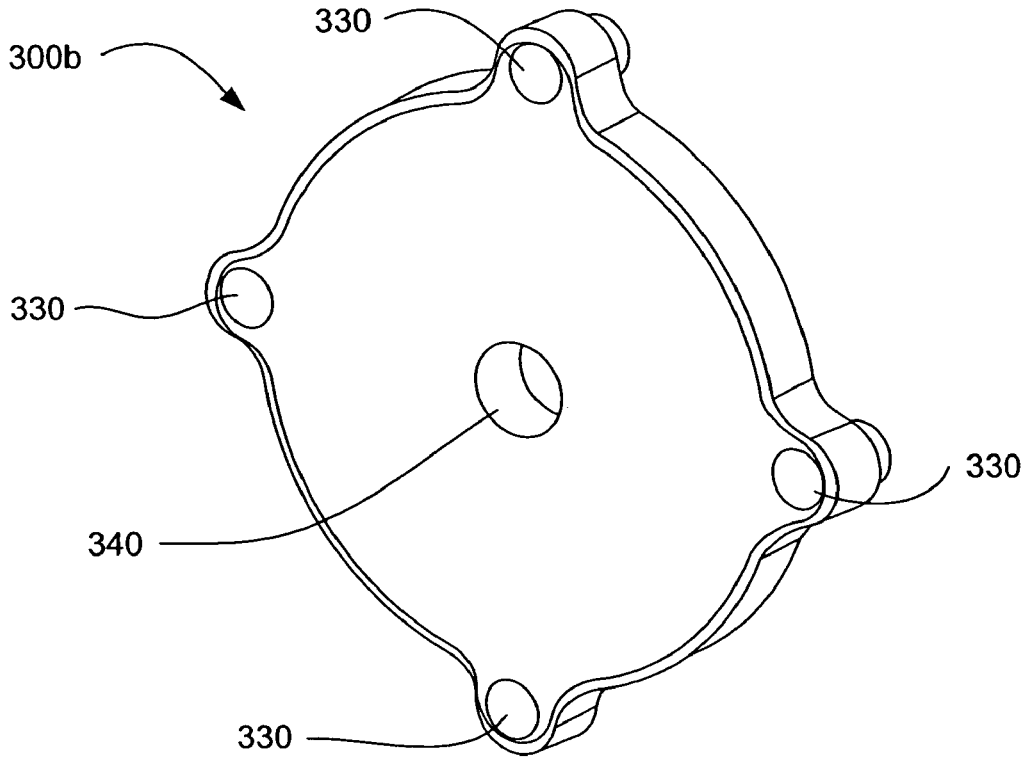
Figure 14B:
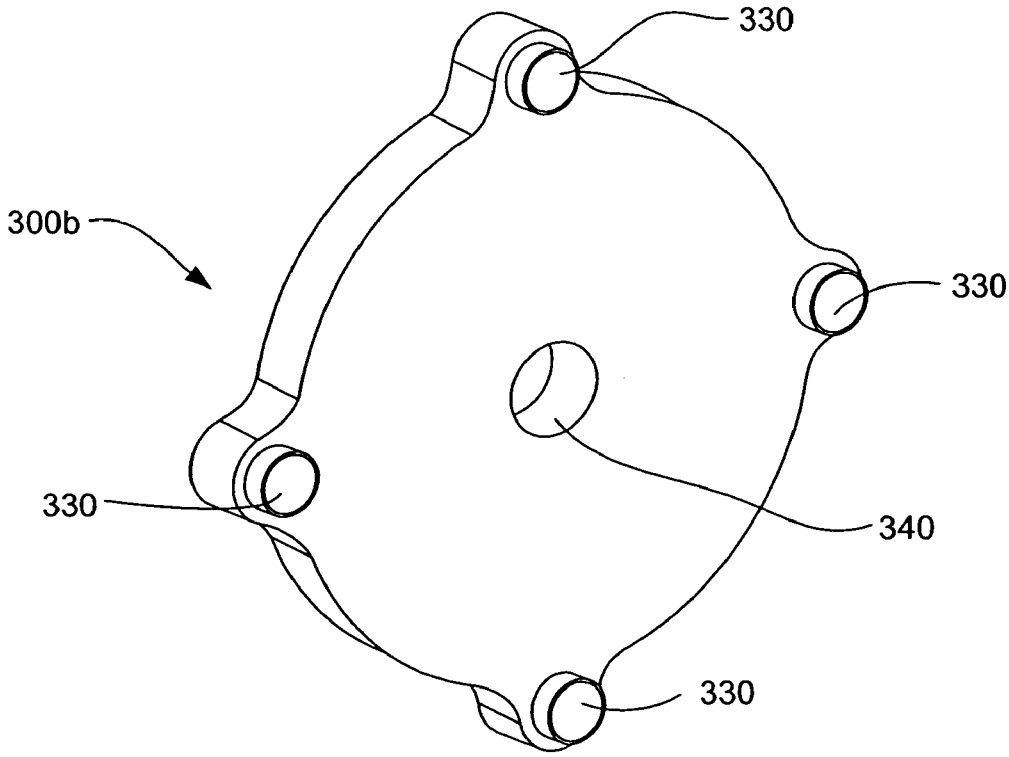

It is noted that one of side plates 300*a* and 300*b* can be integrally formed with stator housing 212. In such an embodiment, only the non-integrally formed side plate 300*a* or 300*b* is connected (e.g., bolted, screwed, heat bonded or welded) to stator housing 212 after rotor 250 is disposed within stator housing 212. FIGS. 13A and 13B show perspective views of side plate 300*a*. FIGS. 14A and 14B show perspective views of side plate 300*b*. In accordance with an embodiment of the present invention, the inner walls of side plates 300*a* and 300*b* (i.e., the walls that face rotor 250 after pump 210 is assembled) are highly polished to minimize the friction between axial ends of rotor 250 and side plates 300*a* and 300*b*.

Figure 11:
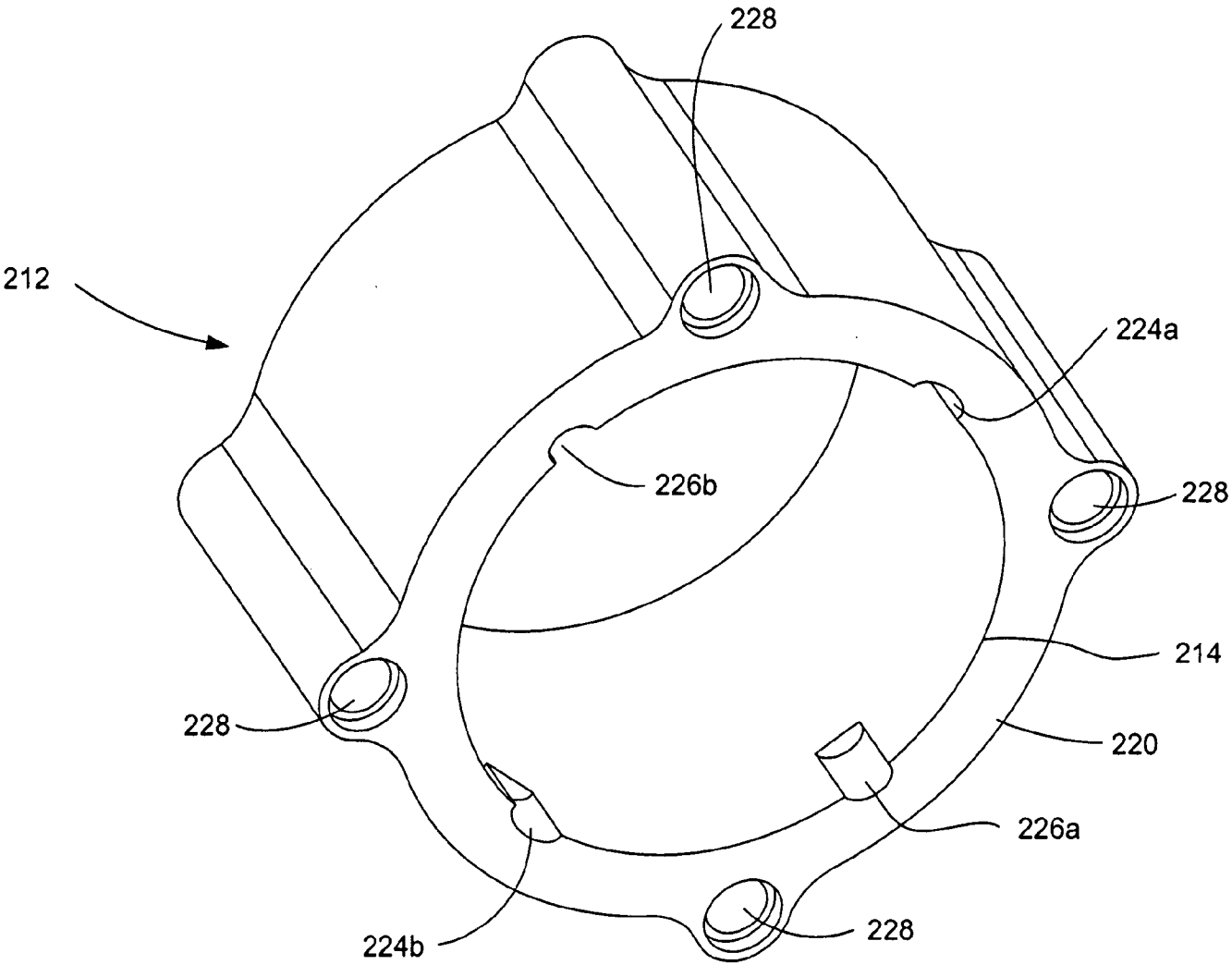
FIG. 11 is a perspective view of the stator housing of the rotary pump of FIG. 9, according to an embodiment of the present invention.

Referring now to FIG. 11, which is a perspective view of stator housing 212, stator housing 212 differs from stator housing 12 in that stator housing 212 does not include inlet ports and outlet ports disposed radially through the stator housing. Rather, stator housing 212 includes inlet channels 224*a*, 224*b* and outlet channels 226*a* and 226*b* that extend through an axial surface 220 and into a portion of inner surface 214 of stator housing 212. Inlet channels 224*a*, 224*b* and outlet channels 226*a* and 226*b* (shown in FIG. 11), respectively align with inlet ports 324*a*, 324*b* and outlet channels 326*a* and 326*b* of side plate 300*a* (shown in FIGS. 13A and 13B).

Figure 12:
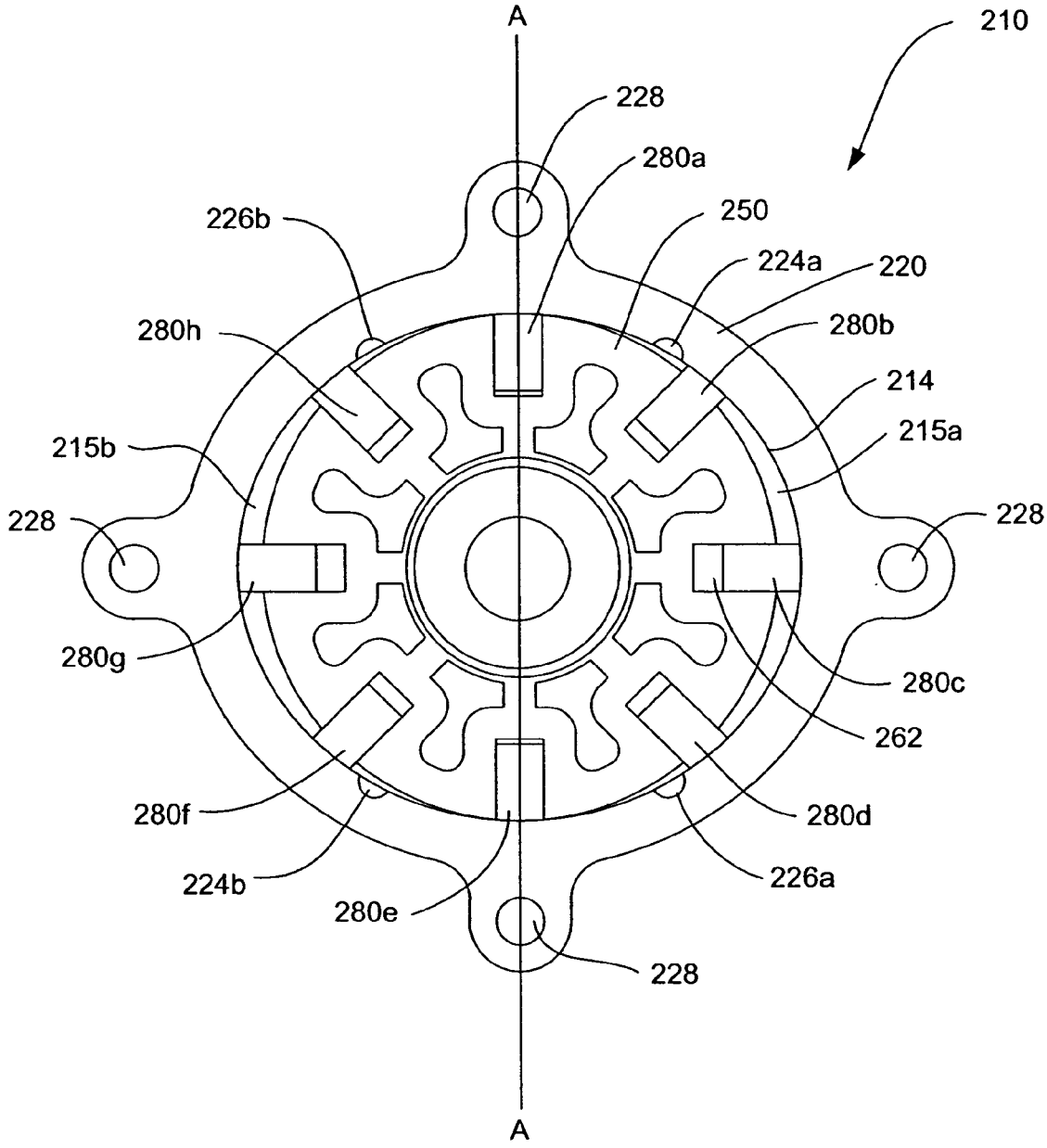
FIG. 12 is a view of the rotary pump of FIG 9 (viewed for the non-motor side), with one non-motor side (i.e., the port side) side plate removed, according to an embodiment of the present invention.

FIG. 12 is a front view of a rotary pump 210 (viewed for the non-motor side, i.e., from the port side) with side plate 300*a* removed, according to an embodiment of the present invention. A first crescent shaped chamber 215*a* is defined between a first half of oblong inner surface 214 (of stator housing 212) and circular outer surface 260 (of rotor 250). A second crescent shaped chamber 215*b* is defined between a second half of oblong inner surface 214 (of stator housing 212), diametrically opposite the first half, and circular outer surface 260 (of rotor 250). First crescent shaped chamber 215*a* and second crescent shaped chamber 215*b* are subdivided, by vanes 280, into smaller chambers or cavities that vary in volume as rotor 250 rotates within stator housing 212. As can be seen, first inlet channel 224*a* and first outlet channel 226*a* are formed within inner surface 214 of stator housing 212 adjacent to first crescent shaped chamber 215*a*. Second inlet channel 224*b* and a second outlet channel 226*b* are formed within stator housing 212 adjacent to second crescent shaped chamber 215*b*.

Rotary pump 210 is a two sided pump, similar to rotary pump 10. One side or half includes first crescent shaped chamber 215*a*, first inlet channel 224*a* and first outlet channel 226*a*. The other side or half includes second crescent shaped chamber 215*b*, second inlet channel 224*b* and second outlet channel 226*b*. Inlet channels 224*a*, 224*b* and outlet channels 226*a*, 226*b* align, respectively, with inlet ports 324*a*, 324*b* and outlet ports 326*a*, 326*b* of side plate 300*a* to provide access to first and second chambers 215*a* and 215*b*.

The operation of rotary pump 210 is similar to the operation of rotary pump 10. As rotor 250 rotates, centrifugal force pushes or urges vanes 280 radially outward against inner surface 214 of stator housing 212, as shown in FIG. 12. As rotor 250 rotates within stator housing 212, each of first and second inlet ports 324*a*, 324*b* draws in fluid, and each of first and second outlet ports 326*a*, 326*b* expels fluid. More specifically, fluid drawn through first inlet port 324*a* and through first inlet channel 224*a* is expelled through first outlet channel 226*a* and out of first outlet port 326*a*. Similarly, fluid drawn into second inlet port 324*b* and through second inlet channel 224*b* is expelled through second outlet channel 226*b* and out of second outlet port 326*b*. This occurs as the cavities (each cavity formed between rotor 250, inner surface 214, and a pair of vanes 280) expand and shrink in volume as rotor 250 rotates within stator housing 212, in a manner similar to that discussed above with regards to rotary pump 10.

In accordance with an embodiment of the present invention, first inlet port 324*a* and second inlet port 324*b* are connected together, for example, using one or more hoses. This would be useful to create a single point at which fluid is drawn into pump 210. If desired, output ports 326*a* and 326*b* can similarly be connected together to provide a single exhaust point. In another embodiment of the present invention, a hose connects first outlet port 326*a* to second inlet port 324*b* to thereby make rotary pump 210 into a dual stage rotary pump. For example, FIG. 13C is a perspective view of the side plate of the rotary pump of FIG. 9 with a hose 440 connecting a first outlet port 326*a* to a second inlet port 324*b*. This can increase the vacuum strength of pump 210, but may reduce the amount of fluid that is displaced during a period of time.

In the figures, rotor 250 is shown as including eight slots 262 within which rest eight sliding vanes 280. Rotor 250 can include less or more slots, as discussed above with respect to rotor 50. Although it is preferable that each vane 280 is not attached in any way to rotor 250 (as described above), the present invention would still work if springs (attaching each vane 280 to a corresponding slot 262) are used to push vanes 280 outward against inner surface 214. However, this is not preferable because it causes the manufacture of pump 210 to be more complex and costly.

In accordance with an embodiment of the present invention, stator housing 212, rotor 250, vanes 280 and side plates 300*a*, 300*b* are all made from plastic. As with rotary pump 10, the use of plastics to produce these main components of rotary pump 210 can substantially reduce production costs and also reduce the overall weight of rotary pump 210. Further, it is noted that rotary pump 210 should be less expensive and less complex to produce than rotary pump 10. This is because most all of the holes and other openings (e.g., ports, and the like) in the components of rotary pump 210 face in the same direction, allowing for simpler tooling and molding.

In accordance with a preferred embodiment of the present invention: stator housing 212 and side plates 300*a*, 300*b* are manufactured from polyetherimide (PEI, marketed as Ultem™); vanes 280 are manufactured from polyimide (TPI, marketed as Torlon™); and rotor 250 is manufactured from polyphenylene sulfide (PPS, marketed as Ryton™ and Techtron™). Preferably, stator housing 212 and side plates 300*a*, 300*b* include about a 30% carbon fiber fill (±5%) for strength and durability and about a 15% (±5%) polytetrafluoro ethylene (PTFE) fill for lubrication. Preferably, vanes 80 also include about a 30% carbon fiber fill (±5%) for strength and durability and about a 15% (±5%) PTFE fill for lubrication. Preferably, rotor 250 includes about 40% carbon fiber fill (±5%) for strength and durability.

An exemplary plastic that meets the above described properties for stator housing 212 and side plates 300*a*, 300*b* is available as RTP part number 2185 TFE 15 Nat./Bk. 15. An exemplary plastic that meets the above described properties for vanes 280 is available as RTP part number 4285 TFE 15 Nat./Bk. 15.3. An exemplary plastic that meets the above described properties for rotor 250 is available as RTP part number 1387 TFE 10 LNat./Bk. 15.

The above mentioned preferred materials as well as the specific percentages of carbon fiber and lubricants for each component of pump 210 were selected after extensive testing of different plastics. The appropriate selection of materials and fills is important because the speeds at which pump 210 operates cause components to become extremely hot, which may cause melting and/or binding of the different components. It was found that materials that run or rub against one another should not be manufactured from the same materials because the same or similar materials tended to undesirably wear through each other and in some instances bind or weld to one another when very hot. It was also found that the components that move, such as vanes 280 and rotor 250, wear differently and more quickly than static components, such as stator housing 212 and side plates 300*a*, 300*b*. There are also different high temperature load points on the components depending on how and where it runs or rubs against other components. The above described materials and fills produced the best results during the extensive testing. Other potential plastics and fills are mentioned above in the discussion of rotary pump 10.

Figure 15:
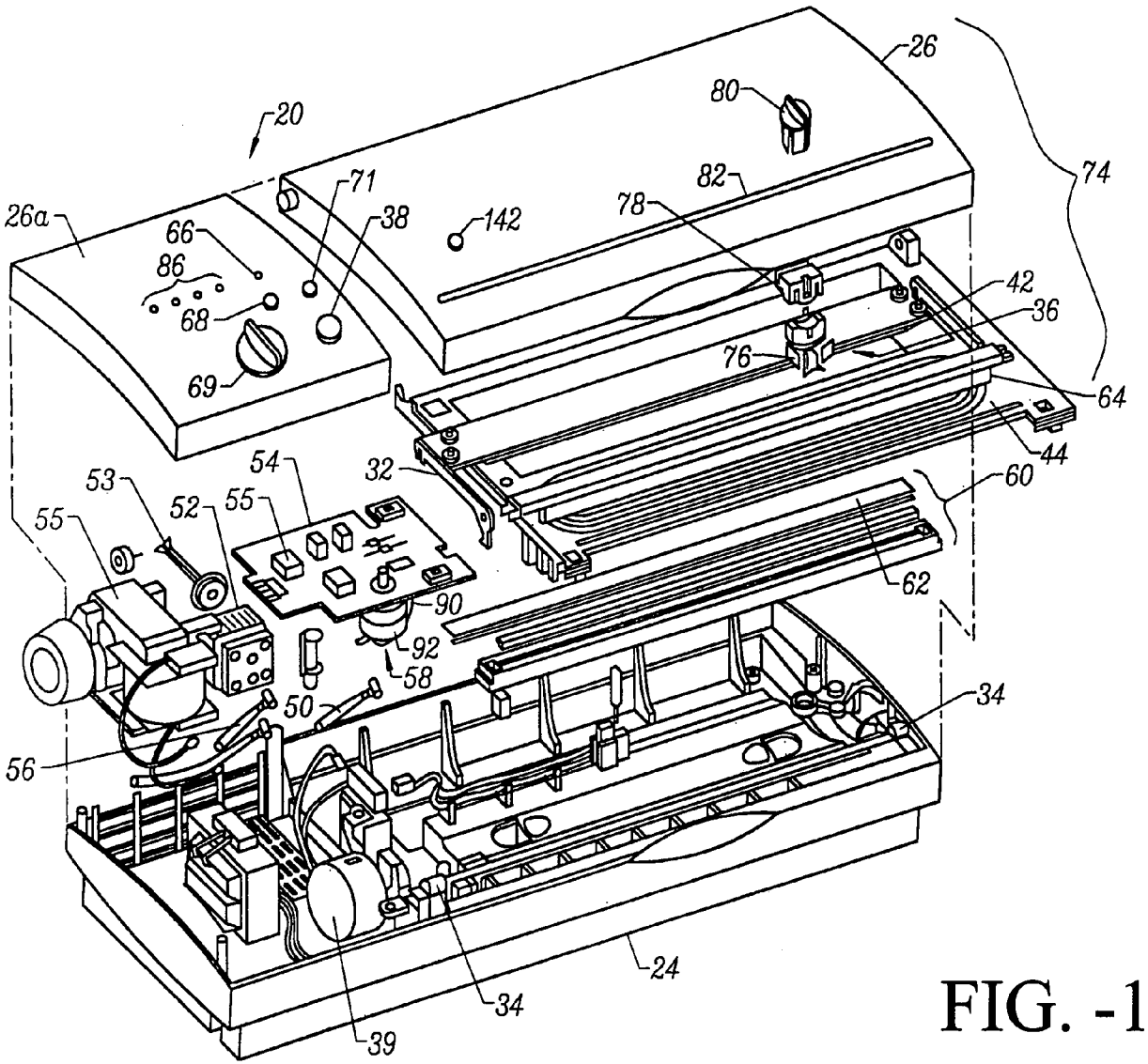
FIG. 15 is an exploded view of a vacuum packaging apparatus including the rotary pump of the present invention.

The above described embodiments of the present invention can be used for any of a number of different purposes, including, but not limited to: chemical processing; marine applications; biotechnology applications; pharmaceutical applications; as well as food, dairy and beverage processing. For example, embodiments of the present invention can be used to evacuate fluid from a container (e.g., a canister or sealable bag) that stores items (e.g., food or clothes). In a more specific example, rotary pumps 10 or 210 (shown as reference numeral 410 in FIG. 15) can be used as the evacuation pump in the vacuum packaging apparatus 400, shown in the exploded view in FIG. 15 and disclosed in detail in U.S. Pat. No. 6,256,968, entitled "Volumetric Vacuum Control," which is incorporated herein by reference in its entirety. Of course, rotary pumps 10 or 210 can be used in many other types of environments where a vacuum pump is useful. Accordingly, the above mentioned exemplary uses of rotary pumps 10 and 210 are not meant to be limiting.

The foregoing description of the preferred embodiments has been provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What is claimed is:

1. Rotary pump comprising:

a. a stator housing having a first side surface and a second side surface, the stator housing having an oblong inner surface axially extending between the first side surface and the second side surface;

b. a rotor disposed in the oblong inner surface, wherein the rotor has a substantially circular outer surface;

c. a vane slot in the substantially circular outer surface of the rotor;

d. a vane slidably moveable in the vane slot;

e. a chamber defined between a portion of the oblong inner surface of the stator and the outer surface of the rotor wherein the chamber further includes a first chamber and a second chamber, wherein the second chamber is diametrically opposed of the first chamber;

f. an inlet port extending in the first side surface and in communication with the chamber wherein the inlet port further includes a first inlet port and a second inlet port, wherein the first inlet port is in communication with the first chamber and the second inlet port is in communication with the second chamber;

g. an outlet port extending in the first side surface and in communication with the chamber wherein the outlet port further comprises a first outlet port and a second outlet port, wherein the first outlet port is in communication with the first chamber and the second outlet port is in communication with the second chamber; and h. a first side plate coupled to the first side surface of the stator housing, wherein the first inlet port and the first outlet port extend through the first side plate into the first chamber, and wherein the second inlet port and the second outlet port extend through the first side plate into the second chamber.

2. Rotary pump comprising:

a. a stator housing having a first side surface and a second side surface, the stator housing having an oblong inner surface axially extending between the first side surface and the second side surface wherein the oblong inner surface of the stator housing further includes:

a first inlet channel aligned with the first inlet port;

ii. a first outlet channel aligned with the first outlet port;

iii. a second inlet channel aligned with the second inlet port; and iv. a second outlet channel aligned with the second outlet port;

b. a rotor disposed in the oblong inner surface, wherein the rotor has a substantially circular outer surface;

c. a vane slot in the substantially circular outer surface of the rotor;

d. a vane slidably moveable in the vane slot;

e. a chamber defined between a portion of the oblong inner surface of the stator and the outer surface of the rotor wherein the chamber further includes a first chamber and a second chamber, wherein the second chamber is diametrically opposed of the first chamber;

f. an inlet port extending in the first side surface and in communication with the chamber wherein the inlet port further includes a first inlet port and a second inlet port, wherein the first inlet port is in communication with the first chamber and the second inlet port is in communication with the second chamber;

g. an outlet port extending in the first side surface and in communication with the chamber wherein the outlet port further comprises a first outlet port and a second outlet port, wherein the first outlet port is in communication with the first chamber and the second outlet port is in communication with the second chamber.

* * * * *